US005709033A

United States Patent [19]

Cummings

[11] Patent Number: 5,709,033

[45] Date of Patent: Jan. 20, 1998

[54] DRAWING DEVICE

[76] Inventor: Charles Arnold Cummings, 5719 Thomaridge Ct., Cincinnati, Ohio 45248

[21] Appl. No.: 684,264

[22] Filed: Jun. 25, 1996

[51] Int. Cl.[6] ..... B43L 11/00

[52] U.S. Cl. ..... 33/27.01; 33/18.1; 446/146

[58] Field of Search ..... 33/27.01, 18.1, 33/26, 27.11, 27.12, 561.1, 561.2; 446/146

[56] References Cited

U.S. PATENT DOCUMENTS

| | | | |
|---|---|---|---|
| 1,878,633 | 9/1932 | Hoferer | 33/27.01 |
| 2,790,245 | 4/1957 | Wilkes | 33/561.2 |
| 3,230,624 | 1/1966 | Fisher | 33/27.01 |
| 3,465,445 | 9/1969 | Fisher . | |
| 3,724,083 | 4/1973 | Mehl | 33/755 |
| 4,825,556 | 5/1989 | Goldfarb | 33/18.1 |

OTHER PUBLICATIONS

Instruction sheet for Spirograph by Kenner (Copyright 1994).

*Primary Examiner*—Christopher W. Fulton

*Attorney, Agent, or Firm*—Jonathan E. Grant

[57] ABSTRACT

An improved design drawing device for drawing amorphous patterns is disclosed. The drawing device contains at least one flexible guide bendable into any desired shape and having an outer circumference wall and an inner circumference wall, at least one solid wheel disk which is rotatable about the inner circumference wall of the flexible guide, at least one hole through the solid wheel disk through which a drawing implement is positionable, wherein the solid wheel disk is rotatable about the inner circumference wall or outer circumference wall of the flexible guide when the drawing implement is positioned through the hole positioned through the solid wheel disk, thereby forming a patterned drawing. The flexible guide is made of a soft plastic which preferably surrounds a flexible bar. As the wheel disk revolves around the inner surface of the flexible guide, the teeth of the wheel disk enter the surface of the flexible guide at right angles to lock into the surface of the flexible guide.

6 Claims, 2 Drawing Sheets

Fig.1
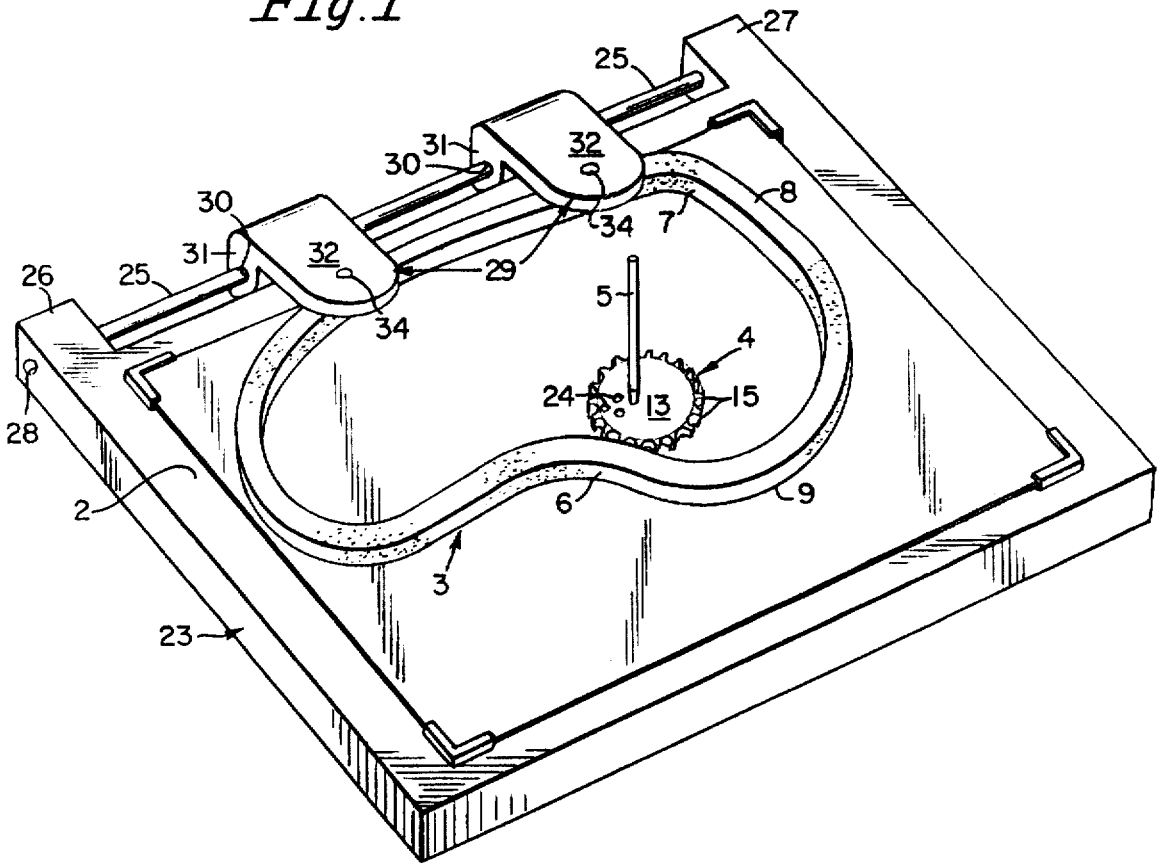
Fig.3
Fig.2
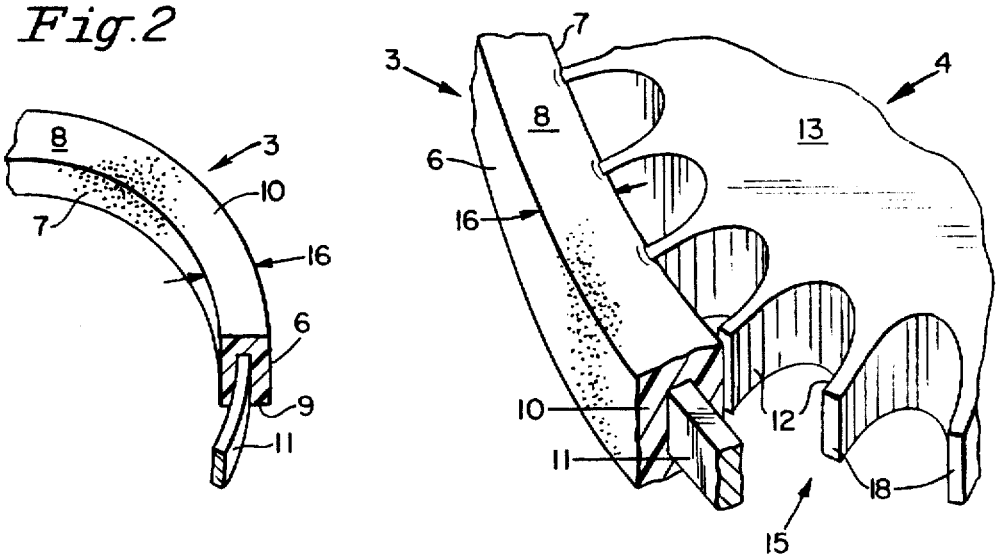

DRAWING DEVICE

BACKGROUND OF THE INVENTION

This patent is an improvement of U.S. patent application Ser. No. 8/584,218 on Jan. 4, 1996, invented by Charles A. Cummings, hereby incorporated by reference.

1. Field of the Invention

The present invention discloses an improved design drawing device, wherein amorphorous patterns may be drawn.

2. Description of the Prior Art

Over the years, a number of devices have been invented to assist individuals in the art of drawing patterns and images.

U.S. patent application Ser. No. 08/584,218 (Cummings) discloses a design drawing device comprises a flat drawing surface, at least one flexible guide bendable into any desired shape and having an outer circumference wall and an inner circumference wall, preferably integral with each other, at least one solid wheel disk having sides, a flat top surface, and a flat bottom surface, the flat top surface and the flat bottom surface being perpendicular to said sides, wherein the solid wheel disk is rotatable about the interior or outer wall of the flexible guide, and at least one hole through the solid wheel disk, at least one hole positioned perpendicular through and to the flat top surface and said flat bottom surface of the solid wheel disk through which a pen or other drawing implement may be placed. The solid wheel disk is rotatable about the inner circumference wall or outer circumference wall of the flexible guide when the drawing implement is positioned through at least one hole positioned through the solid wheel disk, thereby forming a patterned drawing. The flexible guide is preferably a flexible foam ring, and a top surface and a bottom surface of said flexible foam ring is flat. The flexible guide may be made out of a material selected from the group consisting of foam rubber, rubber, and flexible plastic. The flexible guide further comprises foam or soft plastic positioned on the inner circumference of the flexible guide, and cog teeth positioned on the sides of the solid disk allow for the solid disk to be rotated around the inner circumference of the flexible guide.

A plurality of hold down bars holds the flexible guide in a fixed position on the flat surface in a position predetermined by the user or operator of the drawing device. Each hold down bar may comprise a leg, a foot for holding down the flexible guide positioned over the top of the flexible guide, with the foot positioned on top of and perpendicular to the leg, wherein so when the hold down bar is in use, a bottom section of the leg is affixed to the flat surface. Each of the hold down bars may also contain a suction device positioned at the bottom of the leg, to affix the hold down bar to the flat surface.

In yet another embodiment of the invention, a plurality of holes are positioned in the flat surface, and a peg is positioned in the bottom of each of the hold down bars, such that each of the hold down bars may be positioned in the holes in the flat surface.

SUMMARY OF THE INVENTION

The present invention proposes an improved drawing device over U.S. patent application Ser. No. 08/584,218 allowing for the formation of amorphous repetitive patterns. More specifically, a design drawing device for drawing amorphorous patterns is disclosed which makes it easier to rotate a solid cog wheel disk about the interior or outer wall of the flexible guide. Specifically, a flexible guide is made of a soft plastic which preferably surrounds a flexible aluminum bar. As a solid wheel disk revolves around the inner surface of the flexible guide, the teeth of the solid wheel disk enter the surface of the flexible guide at right angles to lock into the surface of the flexible guide, thereby assuring no slippage of the wheel as it turns and progresses around the flexible guide.

In another embodiment of the invention, the flexible guide is connected to at least one and preferably at least two hinged hold down plates at one end of each hold down plate. The top end of the hold down plate is riveted to the flexible guide, while the other end of the hold down plate is connected to a metal axle, wherein the metal bar passes through holes positioned through the foot of the hold down plates. The metal axle is in turn connected to a frame. The hold down plates can be slid together or independently along the length of the metal axle, allowing for the reshaping or movement of the flexible guide. The hinged hold down plates may be lifted, thereby lifting up the flexible guide to allow for removal or replacement of the sheet of paper upon which the drawing was made.

BRIEF DESCRIPTION OF THE DRAWINGS

The above and other objects, features and advantages of the present invention will become more readily apparent from the following description, reference being made to the accompanying drawings in which:

FIG. 1 is a perspective view of the invention;

FIG. 2 is a cross sectional view of the improved flexible guide;

FIG. 3 is an enlarged cross-sectional angular view of the solid wheel disk approaching the flexible guide;

DESCRIPTION OF THE PREFERRED EMBODIMENTS

Figure 4:
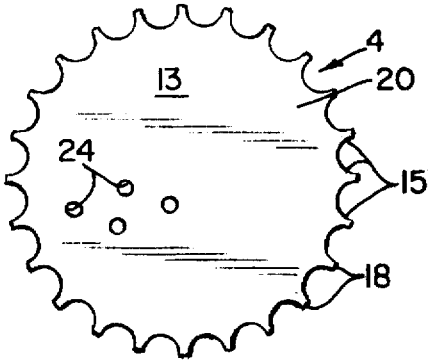
FIG. 4 is a perspective of a solid wheel disk.
Figure 5:
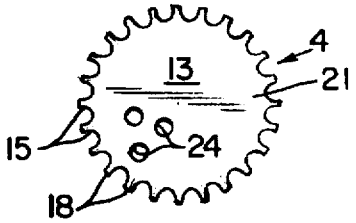
FIG. 5 is a perspective view of a solid wheel disk.
Figure 6:
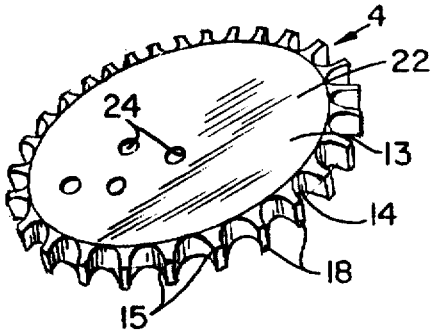
FIG. 6 is a perspective view of an oval wheel disk.

Referring to FIG. 1–7, the drawing device 1 may comprise a flat surface 2 upon which a piece of paper or stack of paper may be placed, a flexible guide 3, and at least one solid cog wheel disk 4, through which a writing implement 5 passes, such that a pattern is drawn on the flat surface when the solid wheel disk 4 is rotated about the flexible guide 3. The flexible guide 3 may be bendable into any shape and has an outer circumference wall 6 and an inner circumference wall 7 which are integral with one another. In a preferred embodiment, the top surface 8 and bottom surface 9 of the flexible guide 3 are flat such that the flexible guide 3 sits flush with the flat surface 2. As shown in FIG. 2, the flexible guide 3 is comprised of a soft foam or plastic covering 10, surrounding a bendable or malleable bar support 11, preferably made out of aluminum. The malleable bar support 11 holds the shape of the flexible guide 3 after the guide 3 has been bent into its desired form.

The wheel disk 4 rotates about the inner circumference wall 7 of the flexible guide 3. The solid wheel disk 4 comprises sides 12, a flat top surface 13, a flat bottom surface 14, with the flat top surface 13 and flat bottom surface 14 being perpendicular to the plane of the sides 12, wherein the wheel disk 4 is rotatable about the inner circumference wall 7 of the flexible guide 3. Teeth 15 on the sides 12 of the cog wheel disk 4 enter the inner circumference wall 7 of the flexible guide 3 at right angles to the width 16 of the soft covering 10 so as to "lock" into the inner circumference wall 7 of the flexible guide 3, thereby preventing "slippage" of the wheel disk 4 as it rotates about the inner circumference wall of the flexible guide 3. The ends 18 of the teeth 15 of the cog wheel disk 4 are flat, allowing for the teeth 15 to securely grip the inner circumference of the flexible guide 3. It is also preferred that the teeth of the cog wheel disk 4 have a midpoint distance separation 19 of from about 0.125 inches to about 0.375 inches, with the preferred midpoint distance separation being about 0.250 inches.

In order to obtain a variant repetitive pattern 17, it is important to note that the measurement of the inner circumference wall 7 not be evenly divided by the circumference of the cog wheel disk 4 as it rotates about the inner circumference wall 7. In other words, the cog wheel disk 4, when being rotated by an integer number, about the inner circumference wall 7, should not end up in the exact location it began its journey.

The relationship in size between the cog wheel disk 4 and the flexible guide 3 may be described mathematically as follows:

If, for example, the circumference of flex curve 3 is X" in circumference, and the circumference of cog wheel disk 4 is B" and the distance from one cog to another cog is ¼", the circumference of cog wheel disk 4 is preferably some fraction of the circumference of the flex curve:

$$B=1/C\ X''+A/X''$$

where A determines the amount the cog wheel is offset as it traverses the flex curve.

Hence, the circumference of cog wheel B must be:

$$(1/C)\ X''+A/X''$$

For instance, if

X=24", A=6 and C=4, then

B=(¼) 24"+6"/24 =6 ¼" circumference.

The cog wheel disk 4 has at least one, and preferably a plurality of holes 24 perpendicular through the plane of the flat top surface 13 of the cog wheel disk 4 and perpendicularly through the plane of the flat bottom surface 14 of the cog wheel disk 4.

The cog wheel disks 4 may be large 20, small 21, oval shaped 22, or any other shape or size which would allow the wheel to revolve about the inner circumference wall 7 of the flexible guide 3.

To operate the design drawing device 1, the user places the writing implement 5 through one of the holes 24 in the cog wheel disk 4. The writing implement passes through the hole such that when the cog wheel disk 4 rotates about the flexible guide numerous times, a pattern is formed. More specifically, the bottom of the flex curve may be held down with one hand as the rotation of the cog wheel disk 4 is guided with the other hand by moving a writing implement positioned through the hole in the cog wheel disk 4, such that the cog wheel disk 4 may be rotated about the inner circumference 7 of the guide 3. Specifically, a frame 23 surrounds the flexible guide 3. This frame 23 may either fit over drawing paper, or the frame 23 may surround the paper. An axle 25 preferably, metal, runs the length of the frame. The metal axle 25 is secured to opposite ends 26, 27 of the length of the frame 23 by conventional means. For example, holes 28 may be positioned through the frame through which the metal axle 25 may be secured. The metal axle may be secured to the frame by screws, glue, nails, or by any other conventional means.

Hold down plates 29 are attached to the metal axle 25. Holes 30 in the legs 31 of the hold down plates 29 allow the hold down plates 29 to be placed on the metal axle 25 prior to the metal axle 25 being movably secured to the frame 23.

At the ends of the arms 32 of the hold down plates 29 are means of attaching the hold down plates 32 to the flexible guide 3. These means may include a rivet, nail, or screw 34 through the arm 32 of the hold down plate 29 and into the top surface 8 of the flexible guide 3. The flexible guide 3 may also be held by means of glue to the hold down plates.

Figure 7:
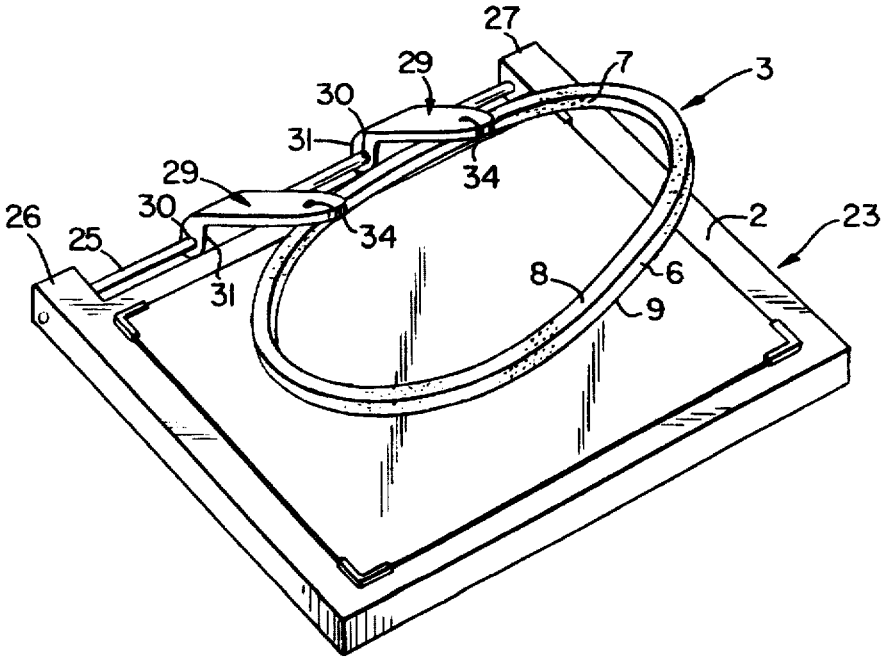
FIG. 7 is another perspective view of the invention with the flexible guide raised to allow paper to be placed in the tray.

As shown in FIGS. 1 and 7, the hold down plates may be slid side to side along the metal axle 25 independently of one another, thereby allowing for the change in the shape of the flexible guide 3 which allows in turn for the change in shape of the pattern being drawn. When the individual is finished using the device, the hold down plates 29 may be lifted and the paper underneath the flexible guide 3 may be removed.

Many modifications and variations of the present invention are possible in light of the above teachings. It is, therefore, to be understood within the scope of the appended claims the invention may be protected otherwise than as specifically described.

What is claimed is:

1. A design drawing device comprising:

a flat surface;

at least one flexible guide, said flexible guide having an outer circumference wall and an inner circumference wall, said flexible guide comprising a soft outer covering and a malleable bar, said soft outer covering surrounding said malleable bar, wherein said flexible guide is bendable into any desired shape;

at least one solid wheel disk said solid wheel disk having sides, a flat top surface, a flat bottom surface, and teeth positioned on the sides of said solid wheel disk, said flat top surface and said flat bottom surface being perpendicular to said sides;

at least one hole through said solid wheel disk, said hole positioned perpendicular through and to said flat top surface and said flat bottom surface; and a drawing implement, said drawing implement positionable through said at least one hole positioned through said solid wheel disk;

wherein said solid wheel disk is rotatable about the inner circumference wall or outer circumference wall of said flexible guide when said drawing implement is positioned through said at least one hole positioned through said solid wheel disk, thereby forming a patterned drawing, and wherein said teeth of said solid wheel disk lock into the inner circumference wall of the flexible guide, thereby preventing slippage of said solid wheel disk as said solid wheel disk rotates about said inner circumference wall of said flexible guide.

2. The design drawing device of claim 1, wherein the ends of the teeth of said solid wheel disk are flat, allowing said teeth to securely grip the inner circumference of the flexible guide.

3. The design drawing device of claim 1, wherein the teeth of said solid wheel disk have a midpoint distance separation of from about 0.125 inches to about 0.375 inches.

4. The design drawing device of claim 3, wherein the teeth of said solid wheel disk have a midpoint distance separation of about 0.250 inches.

5. The design drawing device of claim 1, wherein the inner circumference wall is not evenly divided by the circumference of said solid wheel disk as it rotates about said inner circumference wall.

6. The design drawing device of claim 1, further comprising:

a frame, said frame surrounding the flexible guide;

an axle, said axle secured to opposite ends of the length of the frame;

at least one movable hold down plate, said hold down plate being comprised of a leg and an arm, said leg of said hold down plate having a hole through said leg through which said axle passes, and an end of said arm being attached to said flexible guide, wherein said at least one hold down plate may be slid along the axle thereby allowing for a change in the shape of the flexible guide, allowing for a change in the shape of a pattern being drawn.

* * * * *